United States Patent [19]

Herdieckerhoff

[11] 4,415,145

[45] Nov. 15, 1983

[54] METAL CHARGE TREATMENT APPARATUS

[75] Inventor: Rainer Herdieckerhoff, Unna, Fed. Rep. of Germany

[73] Assignee: Firma Dr. Werner Herdieckerhoff, Unna, Fed. Rep. of Germany

[21] Appl. No.: 412,019

[22] Filed: Aug. 26, 1982

Related U.S. Application Data

[63] Continuation-in-part of Ser. No. 159,679, Jun. 16, 1980, abandoned.

[51] Int. Cl.[3] ..... C21D 1/06

[52] U.S. Cl. ..... 266/253; 266/251; 266/255; 266/262; 266/165

[58] Field of Search ..... 266/165, 251, 252, 253, 266/254, 255, 256, 259, 262, 263

[56] References Cited

U.S. PATENT DOCUMENTS

| | | | |
|---|---|---|---|
| 1,838,015 | 12/1931 | Forster et al. | 266/253 |
| 3,016,314 | 1/1962 | Kellerman | 266/259 |
| 3,801,079 | 4/1974 | Limque | 266/250 |
| 3,866,891 | 2/1975 | Kalbfleisch | 266/256 |
| 3,972,704 | 8/1976 | Loxley et al. | 266/253 |
| 3,998,441 | 12/1976 | Schuster et al. | 266/250 |

FOREIGN PATENT DOCUMENTS

| | | |
|---|---|---|
| 1942801 | 5/1970 | Fed. Rep. of Germany . |
| 892519 | 3/1962 | United Kingdom . |

*Primary Examiner*—John P. Sheehan
*Attorney, Agent, or Firm*—George A. Evans, Sr.

[57] ABSTRACT

Apparatus for treating a metal charge comprises a box furnace and a container containing material for treating the charge. The box furnace is mounted on props whose length is sufficient to permit the container to be positioned under the furnace. The furnace has a shroud within which the charge is heated. Means are provided for introducing the charge into the furnace. The shroud and the container are provided with alignable openings through which the heated charge can be transferred, by charge-transfer means, from the furnace to the container. Pressurized gas is supplied to the interiors of the shroud and the container. The charge-transfer means comprises a carrier supported within the container by a support positioned outside the container. Vertical movement of the support relative to the container causes vertical movement of the carrier.

20 Claims, 15 Drawing Figures

FIG.7
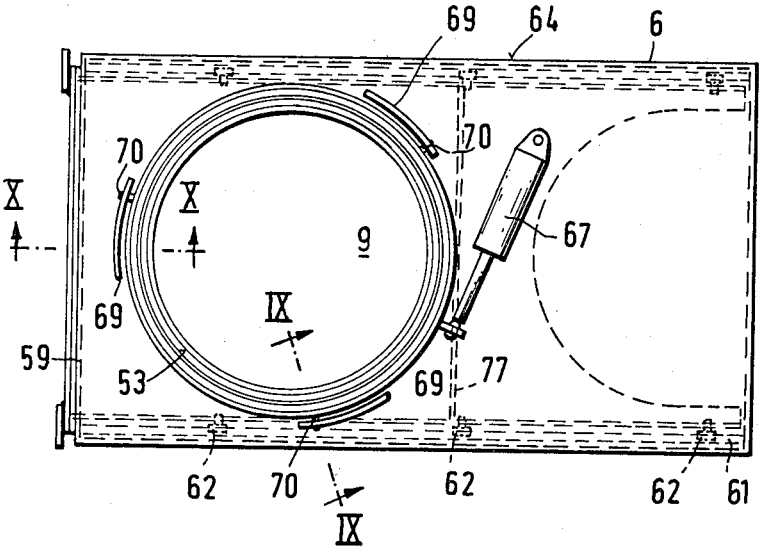
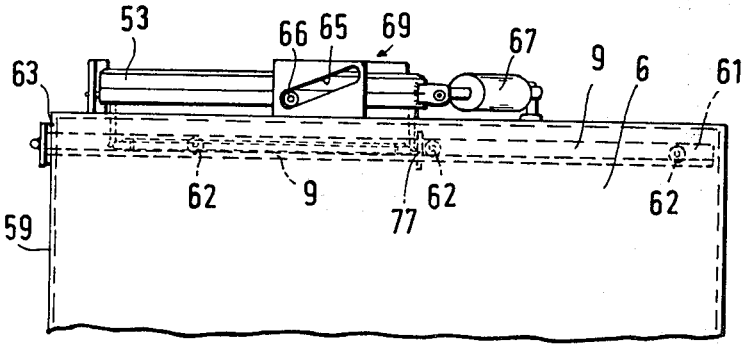
FIG.8

2
49
49
6

2
25
51
55
5
76
53
75
6
9
58

2
53,49
53,49
6

2
26
28
53
6
49
49
48

METAL CHARGE TREATMENT APPARATUS

This application is a continuation in part of an application, Ser. No. 159,679, filed June 16, 1980, and now abandoned.

BACKGROUND TO THE INVENTION

This invention relates to apparatus for treating metal charges, particularly for the improvement of the structure and/or surfaces of metal charges.

Metal charges are usually heated, in an atmosphere of protective gas or in a vacuum, in a box furnace within a shroud. The heated charge is then lowered into a quenching or reagent bath. With such an apparatus, it is known to use a fixed box furnace, and to insert the charge from beneath by means of a ram. A fixed, floor-level, laterally-offset quenching bath is associated with this furnace, the entire space beneath the box furnace and above the quenching bath being formed as a chamber which is closable by a slider (see British patent specification No. 892 519). Apparatus is also known in which the box furance is movable, and can be driven over a floor-level quenching bath or baths (see DE-OS No. 1942801).

The main disadvantage of the apparatus having a fixed box furnace and a fixed quenching bath is that it is extraordinarily expensive. On the other hand, although the apparatus having a movable furnace results in a substantially more elegant working process, it requires extraordinary high constructional expense in order to move the heavy furnace, while a large workshop area is necessary for the accommodation of the quenching baths.

The aim of the invention is to provide an apparatus for treating metal charges which is less expensive than the known types of apparatus.

SUMMARY OF THE INVENTION

The present invention provides apparatus for treating a metal charge, the apparatus comprising a furnace, the furnace housing a shroud within which the charge is heated, means for introducing the charge into the furnace, a container containing material for treating the charge, and charge-transfer means supported by the container for transferring the charge from the furnace to the container, the shroud and the container being provided with alignable openings through which the heated charge can be transferred from the furnace to the container, wherein the furnace is a box furnace mounted on props, the props being sufficiently long as to permit the container to be positioned under the furnace, said opening in the shroud being positioned at the base of the furnace, and said opening in the container being positioned at the top of the container, said charge-introducing means being effective to lift the charge into the shroud through said opening in the base of the shroud, said charge-transfer means comprising carrier means supported within the container by support means positioned outside the container, whereby vertical movement of the support means relative to the container causes vertical movement of the carrier means.

In a preferred embodiment, the apparatus further comprises inter-engageable means for sealing the interiors of the container and the furance from the exterior during transfer of the charge from the furnace to the container, and means for supplying pressurised gas to the interiors of the shroud and the container. Preferably, the charge-introducing means comprises a hoist for lifting the charge into the furnace.

Advantageously, the container is provided with a slidable member for closing its opening, said slidable member being in its closed position except during the transfer of the charge from the furnace to the container.

Advantageously, the container is movable, to bring its opening into, and out of, alignment with said opening in the shroud, along rails laid at ground level. Preferably, there are a plurality of containers, each containing a different treatment material, and wherein at least one set of rails leads from the furnace to a transfer station at which said containers are stored.

Preferably, the support means comprises an inverted U-shaped member, the base of the U-shaped member being positioned above the container, and the arms of the U-shaped member being movably engageable with vertical guides fixed to the outer faces of a pair of opposite sides of the container. Conveniently, the carrier means comprises a pair of carrier legs and a carrier framework, the carrier legs depending from the base of the U-shaped member, and the carrier framework being adapted to support the charge. A crane may be provided for moving the U-shaped member, in which case the length of the container and the distance between the centre of the container opening and the base of the U-shaped member are such that, when said openings are aligned, the U-shaped member is positioned beyond the edge of the furnace so as to be movable freely in the vertical plane. The apparatus of the invention enables a considerably more rational exploitation of existing installations, and it is possible to dispense with the setting up of different installations for different purposes. The individual containers can be brought into use by an appropriate control system, and their movements can be controlled by hand or automatically.

If operations are repeated very frequently, the crane can be automated without difficulty.

Advantageously, the opening in the shroud has a mouth portion, and the container opening is surrounded by an upstanding collar, the mouth portion and the collar constituting said interengageable means. Preferably, the collar is provided with a sluice ring which is movable towards, and away from, said mouth portion.

Conveniently, the sluice ring and said mouth portion are provided with interengageable seals. Advantageously, the seal of said mouth portion is an annular seal which surrounds the shroud opening, and is positioned between the slidable member and the lower surface of the upper wall of the container. Preferably, the upper edge of the sluice ring is provided with a gasket and the lower edge of the sluice ring is shaped to define two vertically-spaced seal faces, said two seal faces being spaced apart by a distance equal to the height through which the sluice ring is movable. In this case, the seal between the interiors of the shroud and the container is good enough to prevent the escape of any gases or vapours released during the treatment process.

As an alternative to the sluice ring, said mouth portion may be provided with an annular passage surrounding the shroud opening, the internal diameter of the annular passage corresponding to the external diameter of the collar, and the annular passage may be connected to a suction pump via inwardly-directed radial passages. Thus, any gases or vapours generated during the treatment process can be removed by suction.

Advantageously, during its opening movement, the slidable member passes through a slot in an end wall of the container, the slidable member being guided by guides provided on the inside surfaces of a pair of opposed side walls of the container.

Preferably, the sluice ring is provided with cam follower means engageable with cam slot means formed in means fixed to the upper wall of the container, the camming arrangement being such that circumferential movement of the sluice ring results in vertical movement of the sluice ring. Conveniently, a ram is provided for imparting circumferential movement to the sluice ring. Where the sluice ring cannot, or should not, be raised, rams may be provided for lifting the container.

In another preferred embodiment, a half-ring is provided on the shroud and a half-ring is provided on the container, the half-rings partially surrounding their respective openings, and wherein the half-rings mate with one another to form a tube, the half-rings constituting said interengageable means. Advantageously, the half-ring on the container is movable into engagement with the half-ring on the shroud by engagement with ramp means fixed to the container.

BRIEF DESCRIPTION OF THE DRAWINGS

The invention will now be described in greater detail, by way of example, with reference to the accompanying drawings, in which:

FIGS. 6–10 show the formation and arrangement of a vertically-movable sluice ring provided at the top of a container, and the arrangement of corresponding seals on the container and the furnace;

BRIEF DESCRIPTION OF PREFERRED EMBODIMENTS

Figure 1:
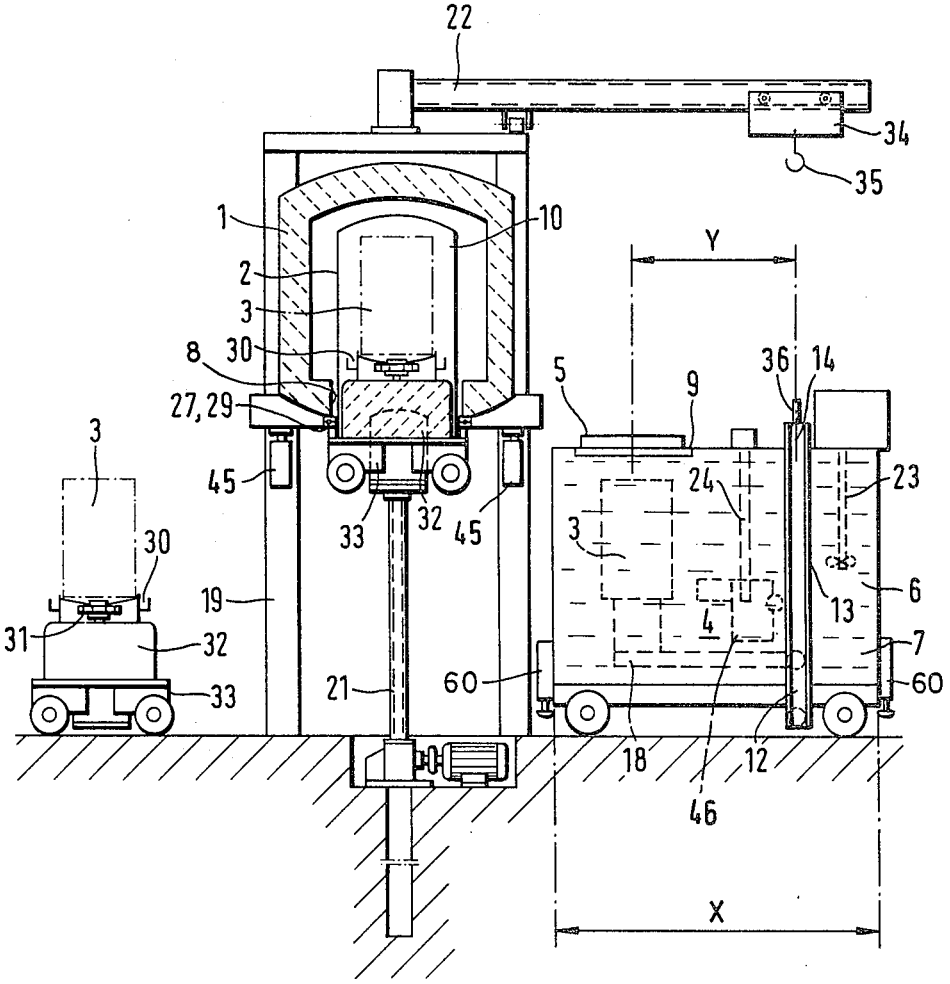
FIG. 1 is a part-sectional side elevation of a box furnace constructed in accordance with the invention, and shows an associated crane and a container.
Figure 15:
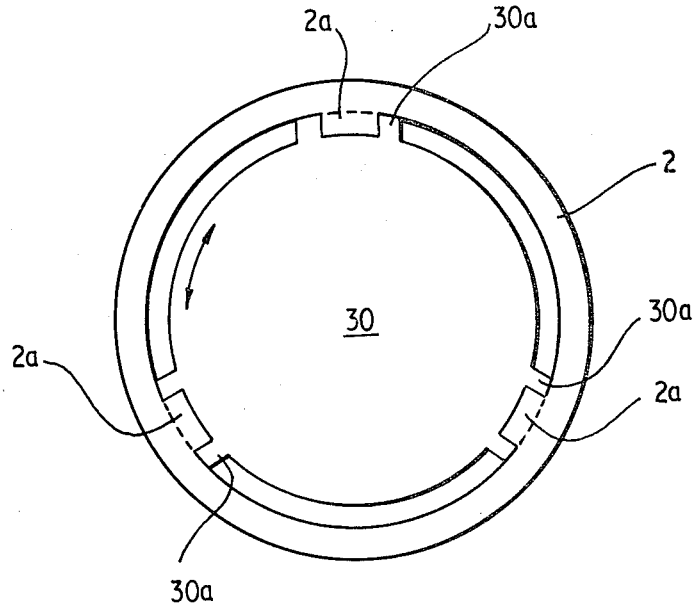
FIG. 15 is a shematic plan view showing means for retaining a charge carrier plate within the furnace.

Referring to the drawings, FIG. 1 shows a box furnace 1 of double-vacuum formation. The furnace 1 is mounted on props 19, and accommodates a shroud (or hood) 2 made of refractory sheet metal. The shroud 2 surrounds a metal charge 3, the charge being supported by a carrier plate (or framework) 30. The carrier plate 30 is mounted on a carrier dish 31 of an insulation ring 32, the insulation plug being carried by a truck 33, several of which are used. The carrier plate 30 is provided with three equispaced, radially-outwardly-extending lugs 30*a* (see FIG. 15) which are alignable with three equispaced, inwardly-extending lugs 2*a* provided on the internal wall of the shroud 2. The trucks 33 are supplied one by one to the furnace 1, FIG. 1 showing, at the left, a second truck 33 which also has an insulation plug 32 and a charge 3. The trucks 33 run on rails 20 beneath the furnace 1, and a hoist 21 is provided for lifting the trucks up to the furnace. As the carrier plate 30 is lifted by the hoist 21, the lugs 30*a* are positioned so as to be out of alignment with the lugs 2*a*. The carrier plate 30 is lifted until its lugs 30*a* lie above the lugs 2*a*, in which position the charge 3 is within the furnace. When a charge 3 is in position in the furnace 1, the carrier plate 30 is rotated, by means of a hydraulic ram (not shown), to align the lugs 30*a* and 2*a*. The associated insultation plug 32 and truck 33 can then be lowered, using the hoist 21, without the charge also being lowered. This is ensured by the cooperation of the lugs 30*a* and 2*a* which support the carrier plate 30 in the shroud 2, once it has been detached from its insulation plug 32. A similar way of holding a carrier plate within a furnace is described in British patent specification No. 899 793, the disclosure of which is incorporated herein by reference. The insulation plug 32 is separated from the charge 3, because it is advantageous not to dip the plug, with the charge, into a quenching bath. Thus, it remains on the truck 33 and is driven out of the region of the furnace 1, after the truck has been set down on the rails 20.

By reason of the high temperature within the furnace 1, the pressure within the chamber 10 formed within the shroud 2 is in excess of the atmospheric pressure. In order to prevent ambient air entering the shroud chamber 10, after the insulation plug 32 is removed, pressurised gas is constantly supplied to the shroud chamber. However, after a very short time a quenching bath 4, formed in a container 6, can be driven into position under the furnace 1. The container 6 is driven into position along the rails by a built-in drive (not shown) or by any other suitable means. The top of the container 6 is provided with an upstanding collar 5 which is shaped to correspond to the contours of the opening 8 at the base of the shroud chamber 10, so that no appreciable air gaps are left therebetween.

The collar 5 is constituted by parts which are resiliently movable axially of the furnace 1, so that an improved air-tight seal is provided between the shroud chamber 10 and the quenching bath 4. The interior of the container 6 (that is the container chamber 7) has a portion containing quenching liquid (the quenching bath 4), and various portions free of quenching liquid (not shown). During this process, the pressurised gas supplied to the shroud chamber 10 seeps out of the gaps left between the collar 5 and the shroud chamber opening 8, and so prevents the access of ambient air.

A slider 9, which hitherto closed the opening at the top of the container chamber 7 is then opened. The container chamber 7 is also provided with pressurised gas, which ensures that all the portions of the container chamber not filled with quenching liquid are raised to a pressure in excess of that of the atmosphere. Once the slider 9 is opened, the two pressurised regions in the container chamber 7 and in the shroud chamber 10 unite.

Meanwhile, a crane 22 is pivoted into the position shown in FIG. 1. The crane 22 has a trolley 34 which is driven fully radially inwards, so that its cable hook 35 can be hooked into the eye 36 of a U-shaped support member 14 associated with the container 6. The support member 14 has a cross-piece 15 and a pair of parallel legs 13. The eye 36 is situated on the cross-piece 15 and the legs 13 are guided in vertical roller guides 12 provided on the outer sides 11 and 11' of the container 6.

Figure 2:
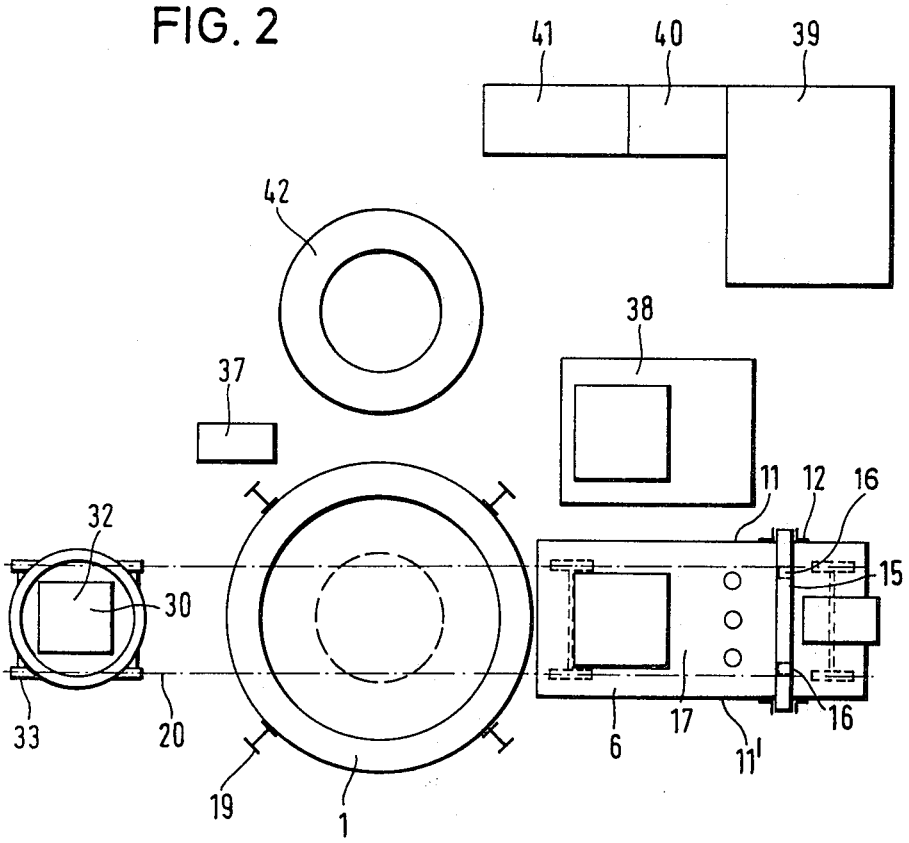
FIG. 2 is a plan view of the arrangement of FIG. 1, and shows various other accessories used with the apparatus of FIG. 1.

Two vertical carrier members 16 depend from the cross-piece 15, these members not being visible in FIG. 1 but are indicated in the plan view of FIG. 2. The carrier members 16 pass through the upper wall 17 of the container 6, and support a carrier framework 18 on which the carrier plate 30 can be set. By hoisting the trolley 34, the U-shaped member 14 (together with the carrier framework 18) is raised. Thus, the carrier framework 18 is lifted up and positioned just beneath the carrier plate 30. The carrier plate 30 is then rotated by means of its hydraulic ram to bring its lugs 30*a* out of alignment with the lugs 2*a* of the shroud 2. This disengages the carrier plate 30 from the shroud 2, and the carrier plate is subsequently supported by the carrier framework 18.

The charge 3 is then dipped into the quenching bath 4 by lowering the carrier framework 18 using the trolley 34. At no time is there any danger of the charge 3 coming into contact with oxygen in the ambient air, or of oxygen penetrating into the container chamber 7.

The vapours and gases, liberated by dipping the charge 3 in the quenching bath 4, are evacuated via an annular passage 27. The annular passage 27 is subject to sub-atmospheric pressure, and the vapours and gases are fed into this passage via radially-inwardly-directed openings 29. Thus, it is ensured that the vapours and gases released during quenching constitute no danger for the operating personnel and the environment.

After the conclusion of the quenching process, the container 6 is driven away out of the region of the furnace 1. The charge 3 can then be removed from the container 6 with the aid of the crane 22. Alternatively, the charge 3 can be removed by any suitable means at another position.

Once the container 6 has been driven out of the region of the furnace 1, another truck 33 (with a new insulation ring 32 and a new charge 3) can be driven in beneath the furnace, and the heating and quenching processes just described are repeated. In this way, a new heating operation can commence before the temperature within the furnace 1 has dropped. The same container 6 can be used for quenching this next charge 3, if conditions permit. Alternatively, another container 6 can be used.

The container 6 may additionally be provided with heating devices 24 and 46, and circulating devices 23.

In order to carry out the process described above, the container 6 must be so dimensioned that the distance between the axis of the furnace 1 and the position of the hoist cable on the trolley 34, when the latter is driven fully inwards, corresponds approximately to the dimension Y between the centre of the opening in the top of the container 6 and the eye 36 on the U-shaped member 14.

Using the process described above, it is possible, for the first time, to carry out a rapid change of charge in a fixed box furnace, without danger of oxygen damage to the charge, all the operations occurring with the furnace at the same heat.

The quenching bath 4 contains a quenching liquid such as oil. Alternatively, it may contain salt. In either case it may also constitute a reagent bath. It is also possible for a reagent bath to replace the quenching bath.

The plan view of FIG. 2 shows the arrangement described above with reference to FIG. 1, but also shows a number of accessories necessary for the execution of the process. Thus, FIG. 2 shows a vacuum station 37 for supplying sub-atmospheric pressure to the passage 27; a spray cleansing installation 38; a gas generator 39, a gas application cabinet 40 and a control box 41 for applying pressurised gas to the shroud chamber 10 and the container 7. An air circulation furnace 42 can also be provided in the region of the crane 22.

Figure 3:
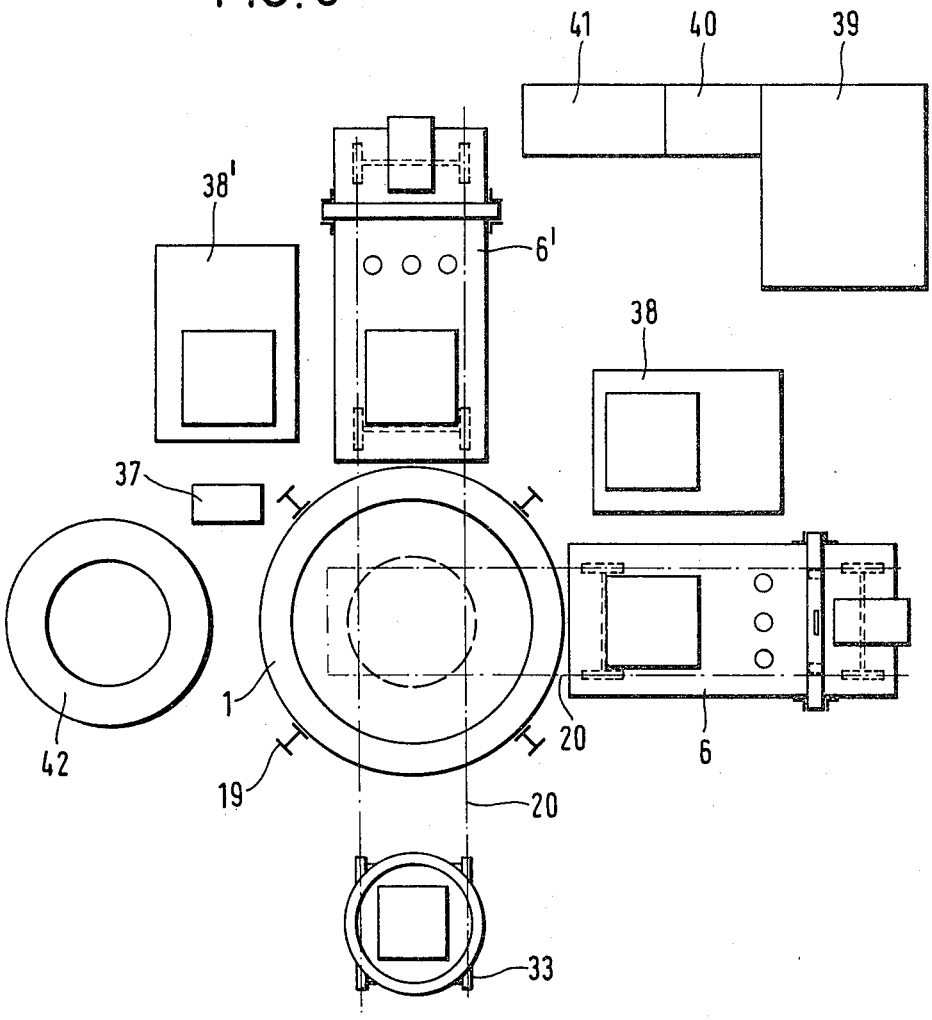
FIG. 3 is a plan view showing a modification of the arrangement of FIG. 2.

FIG. 3 shows a modified arrangement, in which alternative containers 6 and 6' are used. The container 6 is filled with oil, and the container 6' is filled with salt. The container 6' is offset by 90° relative to the container 6 and runs on different rails. Two spray cleansing installations 38 and 38' are also provided, one for oil (38) on the right, and one for salt (38') on the left.

Figure 4:
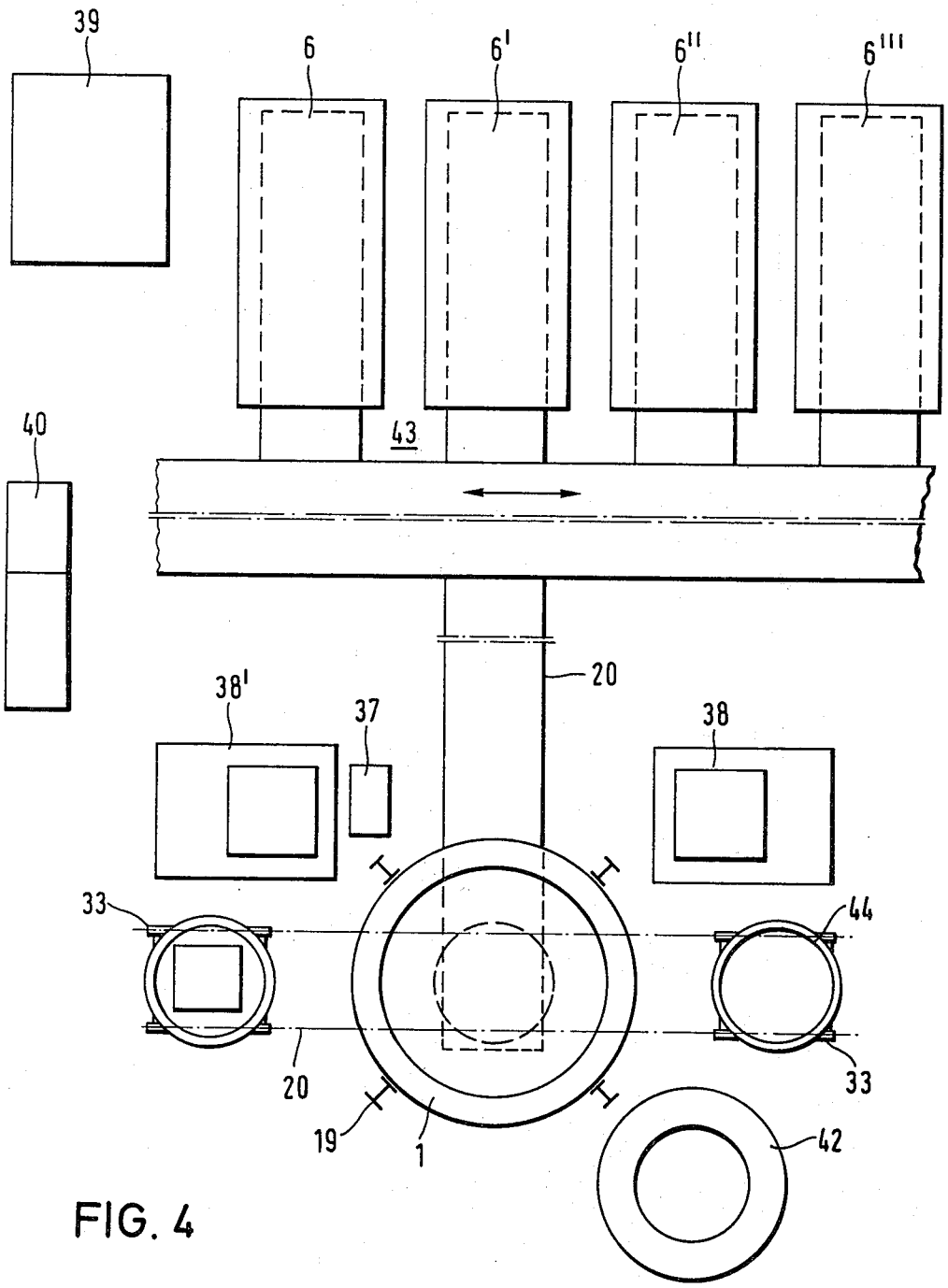
FIG. 4 is a plan view similar to that of FIG. 3, and shows a plurality of reserve container vehicles.

FIG. 4 shows another modified arrangement, in which rails 20 lead from the box furnace 1 to a transfer station 43. The transfer station 43 is used to transfer any one of a plurality of containers 6, 6', 6'', 6''' etc. to the rails 20 for movement towards, and away from, the box furnace 1. Each of the container 6, 6', 6'', 6''' is filled with different reagent liquids, gases or salts. As with the modification of FIG. 3, two spray cleansing installations 38 and 38' are provided, one for salt and one for oil. As with the earlier embodiments, trucks 33 are used for placing charges in the shroud 2. Alternatively, a retort 44 (shown on the right in FIG. 4) can be used for charging the furnace 1.

The process described above permits various hardening and surface improvement procedures to be used. Moreover, these procedures can be used with an absolute exclusion of oxygen, irrespective of which hardening process and which hardening or reagent medium is utilised. It is also possible to work with a vacuum, if the box furnace 1 is formed as a double-vacuum furnace. In this case, it is necessary to carry out some alterations, so that maintenance of the vacuum is rendered possible, by providing appropriate additional seals both in the shroud chamber 10 and in the container chamber 7.

Figure 5:
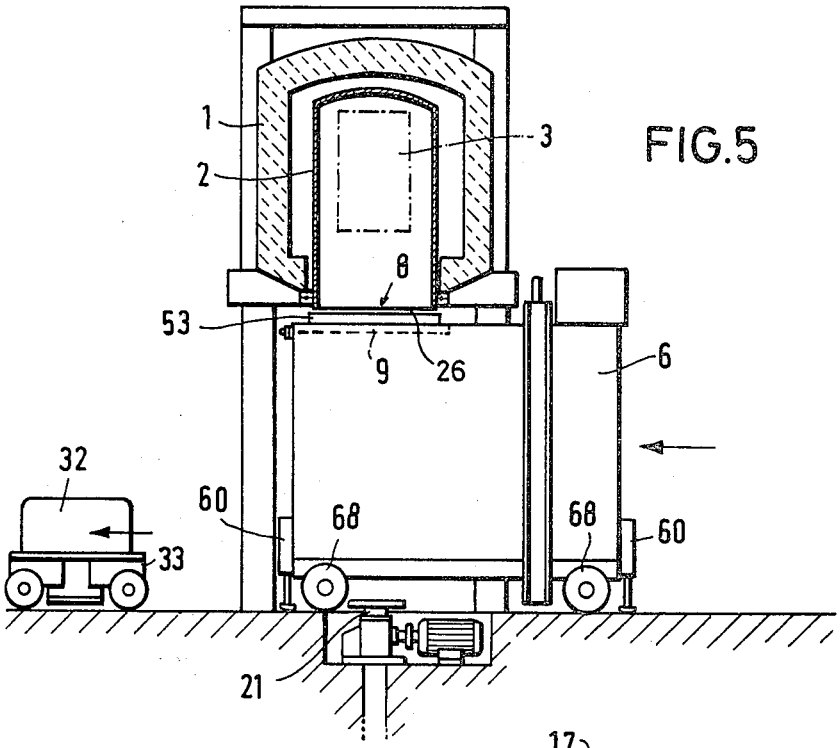
FIG. 5 is a part-sectional side elevation of the furnace, this figure being similar to FIG. 1 but showing a container beneath the furnace.

FIG. 5 shows the container 6 of FIG. 1 in position beneath the box furnace 1, the slider 9 being shown in the closed position. The collar 5 is provided with a sluice ring 53 which is just so high that an adequate air gap 26 remains between the bottom edge of the shroud opening 8 and the upper edge of the sluice ring 53. In order to achieve a sealed closure between the sluice ring 53 and the shroud 2, jacks 60 are provided for raising the entire container 6 (together with its wheels 68). Alternatively, as shown in FIG. 1, rams 45 could be used to move the furnace 1 vertically.

Figure 6:
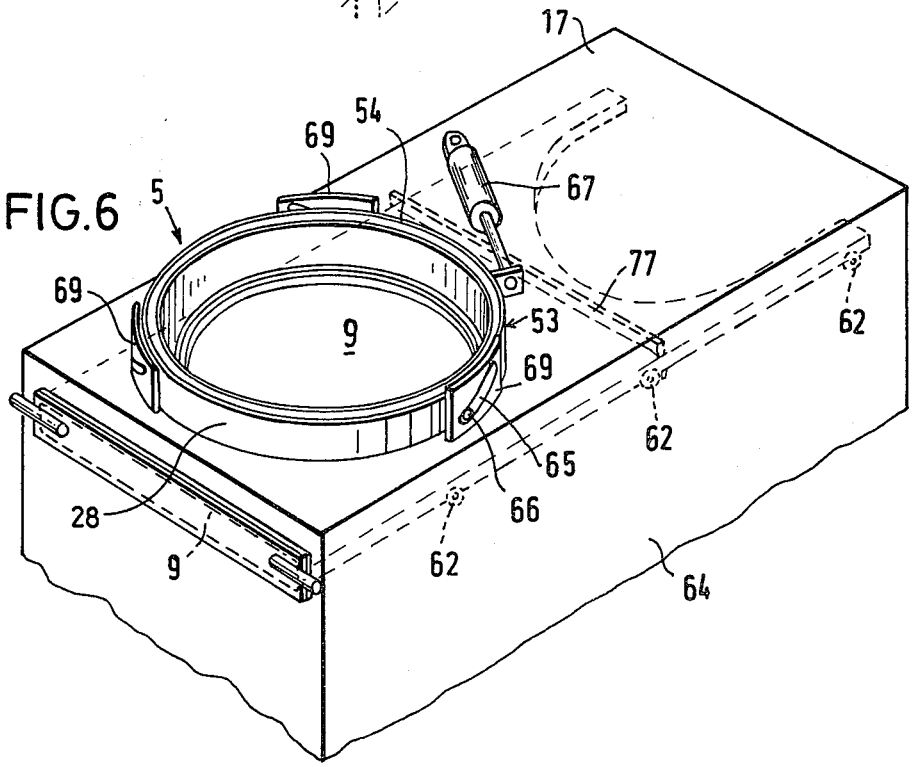

FIGS. 6 to 11 show a modified sluice ring 53, and its mode of operation, in greater detail. As shown in FIGS. 6 and 7, the sluice ring 53 forms a seal with the shroud 2 and with the container 6, this being effected in that the ring is rotatable and carries guide rollers 66 arranged on radial arms 70. The rollers 66 are guided in obliquely-rising slots 65 formed in cam members 69. There are three, equi-spaced cam members 69, and three sets of arms 70 and rollers 66. Thus, when the ring 53 is moved in the circumferential direction, by means of a ram 67, it is forced upwards by the engagement of the rollers 66 in the slots 65 in the fixed cam members 69. The upper edge 54 of the sluice ring 53 forms a seal face.

FIGS. 6 to 9 also show that the slider 9 is guided by rollers 62 in guides 61 provided on the side walls 64 of the container 6. Thus, the slider 9 is guided for horizontal movement beneath the upper wall 17 of the container 6. The perspective view of FIG. 6 is supplemented by the plan view of FIG. 7. The guide rails 61 are shown in dash-dot lines. The guide rails terminate in a slot 63 formed in the end wall 59 of the container 6. This slot 63 serves for the introduction of the slider 9. The slider 9 is provided with a sealing strip (not shown) which seals against the wall 59.

Figure 9:
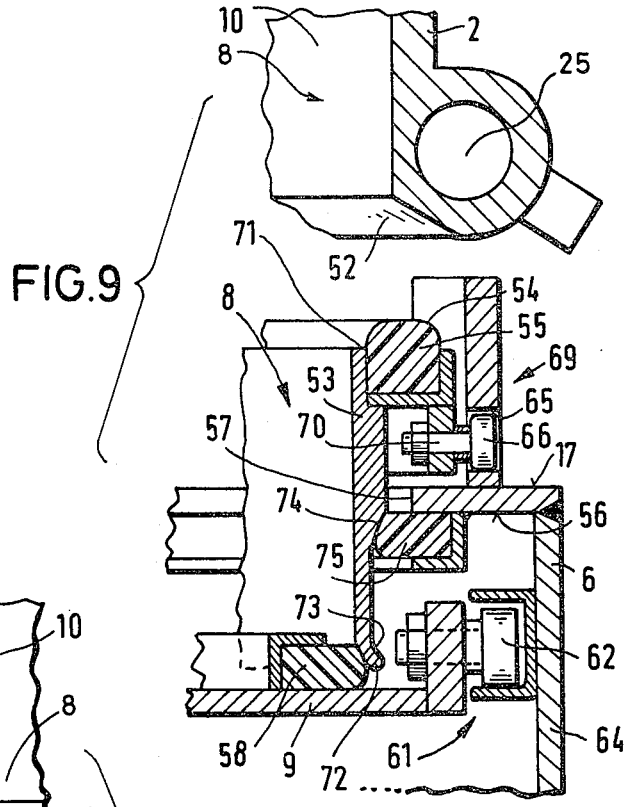
Figure 10:
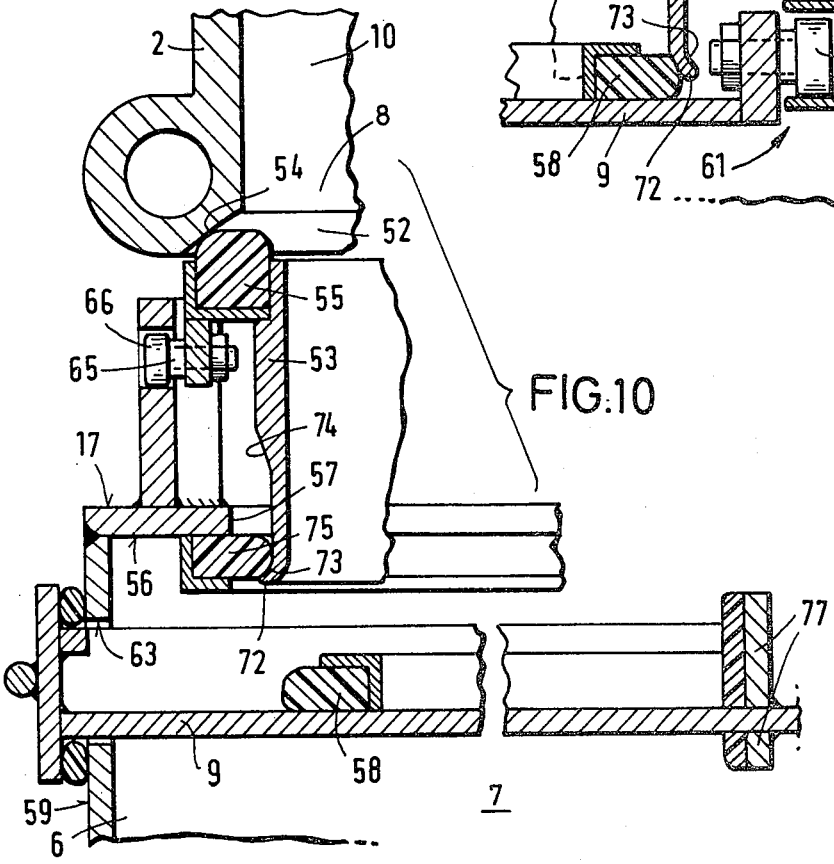

The sectional representation of FIG. 9 explains the function of the raisable sluice ring 53. The furnace opening 8 is surrounded by a seal face 52 formed at the bottom end of the shroud 2. The seal face 52 is provided adjacent to a cooling channel 25. The upper edge 71 of the sluice ring 53 carries a gasket 55 which constitutes the seal face 54 of the sluice ring. An annular seal 75 is provided on the under side 56 of the upper wall 17 of the container 6, the annular seal 75 sealing against a corresponding seal face 74 on the outside of the sluice ring 53. An annular seal 58 is secured to the slider 9, the lower edge 72 of the sluice ring 53 abutting against this seal 58. Thus, when the container opening 57 is closed, no gases can escape from the container chamber 7. When the ram 67 is actuated, the sluice ring 53 rotates and is raised vertically, by the engagement in the rollers 66 and the slots 65, until the seal face of the gasket 55 abuts against the seal face 52 of the shroud 2. A seal face 73 on the lower edge 72 of the sluice ring 53 now lies against the annular seal 75.

The sealing of the container chamber 7 and the shroud chamber 10 is, therefore, unguaranteed over only a very short period because small quantities of gas can escape through briefly-opened gaps. Moreover, as the slider 9 is opened, other briefly opened gaps occur in the region of the slot 63. Therefore, the slider 9 must be opened as quickly as possible. Sealing strips 77 are fitted on the upper and under sides of the slider 9, the strips abutting against the inner edges of the slot 63 when the slider is fully open. This guarantees a complete seal of the container chamber 7 to the exterior when the slider 9 is fully open.

When the slider 9 is fully opened (by pulling it out through the slot 63), the container opening 57 is connected with the furnace opening 8, so that the container chamber 7 and the shroud chamber 10 from one unit. The vapours occurring in the dipping of the hot charge 3 into the quenching bath 4, and the excess pressure thus caused, cannot result in an outflow of environmentally-harmful gases or the like. When the quenching bath 4 has settled, the slider 9 is pushed in quickly, and the sluice ring 53 is lowered so that the container 6 again constitutes a closed chamber. The container 6 is then driven away, leaving the shroud chamber 10 open at the bottom. In order to prevent escape of inert gases, the shroud chamber is subjected to sub-atmospheric pressure. A new charge 3 can then be driven, on its truck 33, beneath the furnace 1; and pushed, with the aid of the hoist 21, into the shroud 2 for the next heating operation.

Figure 11:
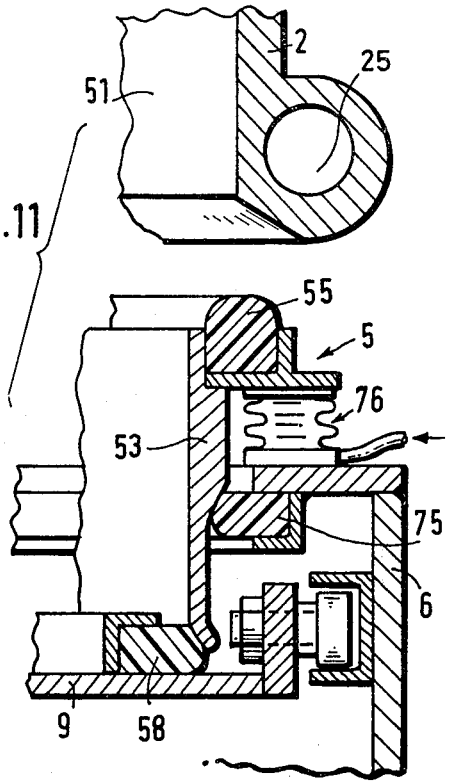
FIG. 11 shows the vertically-movable sluice ring of FIGS. 9 and 10 together with a hydraulic or pneumatic hoist.

FIG. 11 shows a modified arrangement having a different device 76 for lifting the sluice ring 53. This device can be used in place of, or as well as, the cam-type device 65, 66, 69, 70 of FIGS. 6 to 10. The lifting device 76 is a hydraulically or pneumatically-operated bellows, the body of the bellows being made of resilient material.

Figure 12:
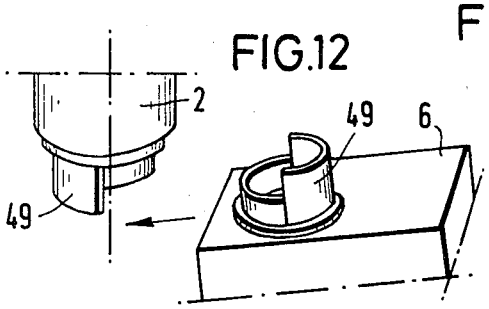
FIGS. 12 & 13 show a modified form of sluice ring that does not have to be veritically movable.
Figure 13:
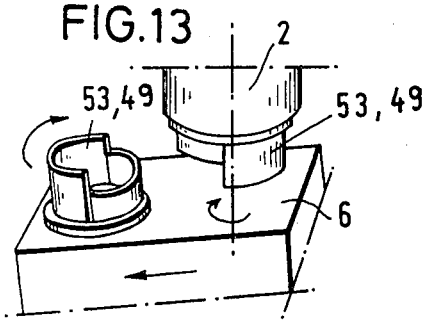

FIGS. 12 and 13 show another form of sluice ring 53 which is divided into two half-rings 49, one half-ring being provided on the top of the container 6, the other half-ring depending from the base of the shroud 2. In this case, closing of the gaps between the ends of the half-rings 49 is achieved as the container 6 is raised, the ends being provided with seals. If the container 6 is to be driven out, along the rails 20, in the same direction in which it was driven in, the half-rings 49 must be rotatable through 180°, as indicated in FIG. 13. This embodiment is advantageous if the rails 20 can be inclined, so that the container 6 travels both inwards and outwards down the gradient. In FIG. 12, the half-rings 49 are not rotatable, so that the container 6 must be driven out in the opposite direction to that in which it was driven in.

Figure 14:
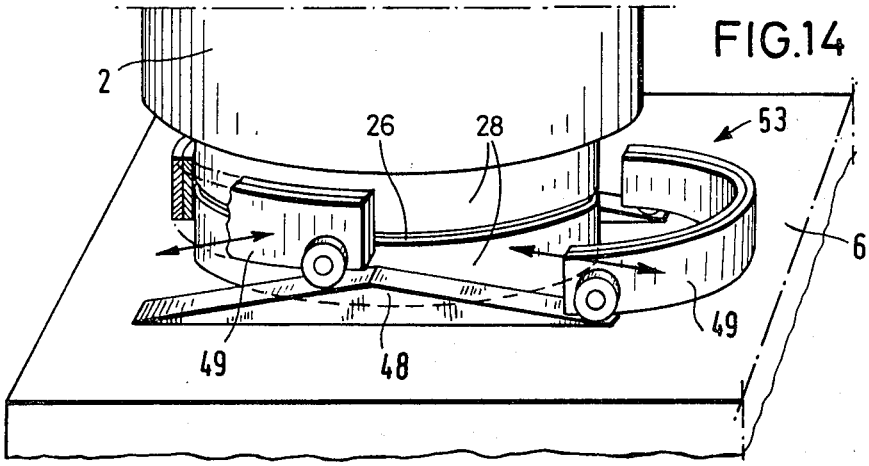
FIG. 14 shows a further modified form of sluice ring having movable parts.

FIG. 14 shows a sluice ring 53 whose height is less than that of the earlier embodiments. Here again, the sluice ring 53 is constituted by two half-rings 49, which are radially displaceable, as indicated by the arrows. The half-rings 49 are raised, on ramp faces 48, into sealing engagement, so that their gaskets (or seal faces) form a seal between the shroud chamber 10 and the container chamber 7. As soon as the two half-rings 49 are at a distance from one another corresponding to their diameter, the container 6 can be driven out (or in) transversely of the direction of movement of the half-rings 49, since there is an air gap 26 between the two axially-spaced parts which form the collar 5.

I claim:

1. Apparatus for treating a metal charge, the apparatus comprising a furnace, the furnace housing a shroud within which the charge is heated, means for introducing the charge into the furnace, a container containing material for treating the charge, and separate charge-transfer means arranged within and supported by the container for transferring the charge from the furnace to the container, the shroud and the container being provided with alignable openings through which the heated charge can be transferred from the furnace to the container, wherein the furnace is a box furnace mounted on props, the props being sufficiently long as to permit the container to be positioned under the furnace, said opening in the shroud being positioned at the base of the furnace, and said opening in the container being positioned at the top of the container, said charge-introducing means being effective to lift the charge into the shroud through said opening in the base of the shroud, said charge transfer means comprising carrier means supported within the container beneath the charge and second support means positioned laterally of the charge and operable from outside the container, whereby vertical movement of the support means relative to the container causes vertical movement of the carrier means.

2. Apparatus according to claim 1, further comprising inter-engageable means for sealing the interiors of the container and the furnace from the exterior during transfer of the charge from the furnace to the container.

3. Apparatus according to claim 1, further comprising means for supplying pressurised gas to the interiors of the shroud and the container.

4. Apparatus according to claim 1, wherein the charge-introducing means comprises a hoist for lifting the charge into the furnace.

5. Apparatus according to claim 1, wherein the container is provided with a slidable member for closing its opening, said slidable member being in its closed position except during the transfer of the charge from the furnace to the container.

6. Apparatus according to claim 1, wherein the container is movable, to bring its opening into, and out of, alignment with said opening in the shroud, along rails laid at ground level.

7. Apparatus according to claim 6, wherein there are a plurality of containers, each containing a different treatment material, and wherein at least one set of rails leads from the furnace to a transfer station at which said containers are stored.

8. Apparatus according to claim 1, wherein the support means comprises an inverted U-shaped member, the base of the U-shaped member being positioned above the container, and the arms of the U-shaped member being pivotally engageable with vertical guides fixed to the outer faces of a pair of opposite sides of the container.

9. Apparatus according to claim 8, wherein the carrier means comprises a pair of carrier legs and a carrier framework, the carrier legs depending from the base of the U-shaped member, and the carrier framework being adapted to support the charge.

10. Apparatus according to claim 8, further comprising a crane for moving the U-shaped member.

11. Apparatus according to claim 8, wherein the length of the container and the distance between the centre of the container opening and the base of the U-shaped member are such that, when said openings are aligned, the U-shaped member is positioned beyond the edge of the furnace so as to be movable freely in the vertical plane.

12. Apparatus according to claim 1, wherein the container is provided with means for circulating the treatment material.

13. Apparatus according to claim 1, wherein the container is provided with means for heating the treatment material.

14. Apparatus according to claim 1, wherein the treatment material is a quenching liquid.

15. Apparatus according to claim 14, wherein at least one further quenching bath is provided.

16. Apparatus according to claim 1, wherein rams are provided for lifting the container.

17. Apparatus according to claim 1, wherein rams are provided for varying the height of the furnace.

18. Apparatus according to claim 6, wherein, during its opening movement, the slidable member passes through a slot in an end wall of the container, the slidable member being guided by guides provided on the inside surfaces of a pair of opposed side walls of the container.

19. In apparatus for treating metal charges including a furnace having a bottom opening through which the charge is transferred to and from the furnace and means for lifting the charge into the furnace, a separate container for receiving and treating the charge after it has been heated in the furnace, said container having a top opening registrable with the bottom opening in the furnace, charge transfer means having carrier means supported by the container arranged to support the charge while lowering it from the furnace into the container, and second support means positioned laterally of the charge and operable from outside the container arranged to raise and lower the carrier means while the container is positioned under the furnace with the openings in registry as aforesaid.

20. Apparatus for treating a metal charge, the apparatus comprising a box furnace mounted on props, the furnace housing a shroud within which the charge is heated, fixed piston hoist means for introducing the charge into the furnace, a quenching container containing fluid for quenching the charge, the quenching container being provided with wheels which run along rails positioned between the props, said props being sufficiently long so as to permit the quenching container to be positioned under the furnace, and movable charge-transfer means supported by the quenching container for transferring the charge from the furnace to the quenching container, the shroud and the quenching container being provided with alignable openings through which the heated charge can be transferred from the furnace to the container, said opening in the shroud being positioned at the base of the furnace, and said opening in the quenching container being positioned at the top of the container, said charge-introducing means being effective to lift the charge into the shroud through said opening in the base of the shroud, said charge-transfer means comprising carrier means movable vertically in alignment with said opening in the top of the quenching container, the carrier means being supported within the quenching container by a carrier framework, and vertically movable offset hoisting means positioned outside the quenching container.

* * * * *